United States Patent [19]

Lee

[11] 4,375,585

[45] Mar. 1, 1983

[54] DEFORMABLE SWITCH KEYBOARD

[75] Inventor: Hugh Lee, San Jose, Calif.

[73] Assignee: Atari, Inc., Sunnyvale, Calif.

[21] Appl. No.: 387,900

[22] Filed: Jun. 14, 1982

Related U.S. Application Data

[63] Continuation of Ser. No. 223,654, Jan. 8, 1981, abandoned.

[51] Int. Cl.[3] ..... H01H 13/70; H01H 9/00

[52] U.S. Cl. ..... 200/5 A; 200/159 B; 200/308

[58] Field of Search ..... 200/5 A, 46, 159 B, 200/292, 308, 314, 317, 86 R, 340

[56] References Cited

U.S. PATENT DOCUMENTS

| | | | |
|---|---|---|---|
| 3,576,407 | 4/1971 | Stephens, Jr. | 200/46 |
| 3,617,666 | 11/1971 | Brave | 200/86 R |
| 3,935,485 | 1/1976 | Yoshida | 340/365 A X |
| 3,995,126 | 11/1976 | Larson | 200/5 A |
| 4,066,850 | 1/1978 | Heys, Jr. | 200/293 X |
| 4,071,718 | 1/1978 | Harden | 200/308 X |
| 4,314,116 | 2/1982 | Gordon | 200/308 X |

OTHER PUBLICATIONS

IBM Technical Disclosure Bulletin; Johnson, D. O., Jr., Keyboard and Wiping Contact Assembly; Dec. 1970, vol. 13, No. 7, pp. 1962, 1963.

*Primary Examiner*—J. R. Scott

*Attorney, Agent, or Firm*—Townsend and Townsend

[57] ABSTRACT

A deformable switch keyboard assembly with a flexible unitary top member, a compressible intermediate switch assembly layer and a bottom member providing mechanical support for the intermediate assembly and mechanical isolation for the switching function.

The top member has a plurality of switch site defining regions extending in a first direction and located in a predetermined array to define the keyboard. The intermediate switch assembly has a plurality of switch sites each underlying a different one of the top member projections. The bottom member has first and second sets of projections extending toward the top member, each of the first set of projections underlying a different one of the switch sites and providing a compression contact beneath the intermediate switch assembly when the corresponding top member region is actuated to advance in the first direction. Each of the second set of projections is located intermediate different adjacent ones of the switch sites and is longer than any of the first set of projections in order to provide mechanical isolation between an actuated switch site and the remainder of the switch sites.

6 Claims, 6 Drawing Figures

DEFORMABLE SWITCH KEYBOARD

CROSS REFERENCE TO RELATED APPLICATION

This application is a continuation of application Ser. No. 223,654, filed Jan. 8, 1981, now abandoned.

BACKGROUND OF THE INVENTION

This invention relates to electromechanical keyboards of the type used in a wide variety of applications.

Many electromechanical keyboard designs are known which are used to provide electrical signals indicating the actuation of one of a plurality of switches. In many applications, the increasing trend is toward simplicity of design and low cost, particularly in consumer oriented electronic devices, such as video games. Thus, the evolution of electromechanical keyboard designs has progressed from switch assemblies having individual key top, electromechanical switch and return spring components, through designs employing individual dome switches fabricated from a suitable material (such as beryllium copper), to assemblies incorporating a laminated sandwich in which the switching elements comprise conductive layers separated by an insulating layer, and associated switch actuation elements, typically projections suspended above the sandwich and designed to squeeze the sandwich against a flat supporting base.

SUMMARY OF THE INVENTION

The invention comprises an improved keyboard assembly which is capable of being manufactured at extremely low cost, can be configured in a wide variety of key switch patterns and provides extremely reliable, long-life operation.

The keyboard assembly of the invention includes three essential components: a top member, a bottom member, and an intermediate multilayered deformable switch assembly. The intermediate assembly includes top and bottom insulating layers, separate electrically conductive elements positioned within the top and bottom insulating layers and normally separated from one another typically by means of an apertured insulating layer. The top member comprises a rigid but flexible sheet having individual switch site defining regions located thereon in a preselected array and serving the function of a push button. The bottom member comprises a relatively rigid substrate having first and second upwardly extending projections of unequal height. The first set of projections is of lower height and each such projection is positioned directly underneath the switch site defining regions of the top member. The second set of projections is of greater height and are positioned substantially at the midpoint between adjacent switch site defining regions of the top member.

In use, in the normal unactuated state the intermediate assembly is supported by the second set of projections in such a manner that none of the individual switches contained in the intermediate assembly are actuated (i.e. none of the first and second conductors is in actual contact). When a given switch site is depressed by an operator fingertip, the top member flexes in a downward direction and presses the underlying switch region of the intermediate assembly into mechanical contact with the underlying lower height projection from the first set. In addition, the two projections from the second set which straddle the selected switch site prevent actuation of any other switch in the intermediate assembly by virtue of the greater height of the second projections.

The top member is preferably fabricated as a one-piece panel having the predetermined array of switch sites, while the bottom member may be integrated into the housing of the associated electronic device.

For a fuller understanding of the nature and advantages of the invention, reference should be had to the ensuing detailed description taken in conjunction with the accompanying drawings.

DESCRIPTION OF THE PREFERRED EMBODIMENTS

Figure 1:
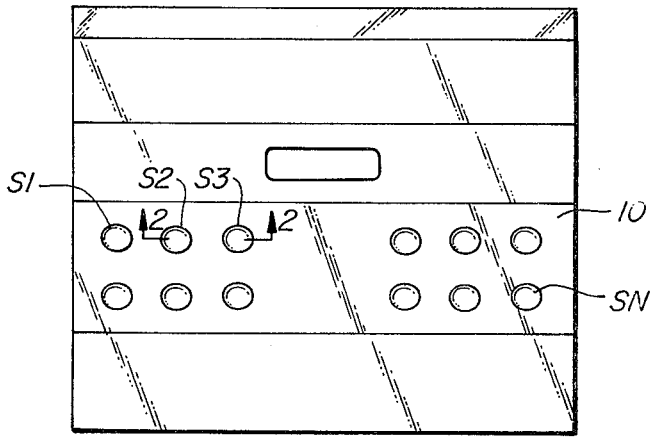
FIG. 1 is a top plan view of an electronic apparatus incorporating the invention.
Figure 2:
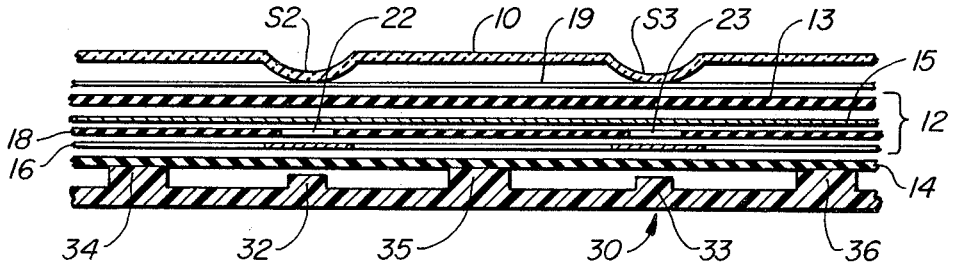
FIG. 2 is a sectional view taken along lines 2—2 of FIG. 1 illustrating the keyboard in the unactuated position.

Turning now to the drawings, FIG. 1 illustrates the top surface of an electronic video game having a keyboard incorporating the invention. As seen in this Fig., a plurality of switch sites S1, S2 . . . , SN are arranged in a predetermined pattern as a keyboard layout on the video game housing. As seen in FIG. 2, each switch site is formed as a concave depression in an essentially planar sheet 10. Sheet 10 is preferably formed from a suitable plastic material as a monolithic member and may be attached to the housing by any suitable means, such as a snap fit arrangement or a suitable adhesive.

Immediately underlying top sheet 10 is an intermediate switch assembly generally designated with reference numeral 12 and including a top insulative layer 13, a bottom insulative layer 14, a first electrically conductive path 15 and a second electrically conductive path 16. Conductive paths 15 and 16 are normally physically separated and, in the embodiment shown, this function is achieved by means of an intermediate insulative layer 18 having a plurality of apertures (only two of which are illustrated and designated with reference numerals 22 and 23).

Underlying the intermediate switch assembly is a bottom member generally designated with reference numeral 30 and having two groups of upwardly extending projections: a first group underlying the switch sites (projections 32, 33) and a second group of greater height than the first group and underlying the midpoint of the distance between adjacent switch sites on top member 10 (projections 34–36). Projections 32, 33 of the first group cooperate with the associated switch sites S2, S3 and the aligned portions of intermediate switch assembly 12 to enable individual switch actuation. Projections 34–36 of the second group provide mechanical support for the intermediate switch assembly 12 and also isolate the switch sites from one another to ensure individual actuation of only one switch at a time.

Figure 3:
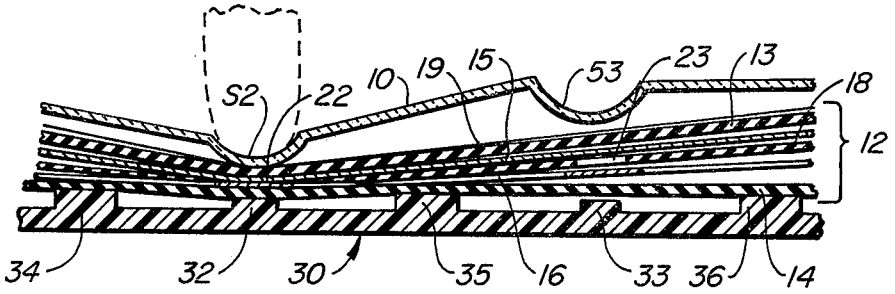
FIG. 3 is a sectional view similar to FIG. 2 illustrating one of the switches operated.

FIG. 3 illustrates the operation of the preferred embodiment when the S2 switch site is depressed by the fingertip of a human operator. As seen in this Fig., the region of top member 10 adjacent switch site S2 is deformed downwardly and switch site S2 compresses that portion of intermediate switch assembly 12 immediately below against underlying projection 32, so as to result in mechanical contact between the two conductive layers 15, 16. In addition, flanking projections 34, 35 mechanically isolate the actuated region surrounding switch site S2 from adjacent regions (such as S3) so that only the S2 switch site region is operated. It should be understood that, for purposes of illustration, the vertical spacing between the members 10, 12 and 30 is greatly exaggerated in FIGS. 2 and 3. In the actual embodiment of the invention, there is physical contact not only between projection 35 and the overlying portion of intermediate switch assembly 12 but also between the upper surface of switch assembly 12 and the intermediate overlying portion of top member 10. Thus, the flanking projections 34, 35 from the second group of projections act as fulcrum points to permit deflection of member 10 therebetween and to prevent deflection of member 10 outboard of the flanking projections 34, 35.

In the preferred embodiment, top member 10 is fabricated from a clear plastic material such as ABS polymer and an additional sheet 19 is provided which carries indicia for identifying the function of each switch site S1–SN. Sheet 19 may be fabricated from paper, plastic or any other thin flexible sheet material which does not interfere with the operation of the keyboard assembly.

It should be understood that, for purposes of simplicity and clarity, only two conductive paths 15, 16 have been illustrated for the intermediate switch assembly 12. In most practical applications, there are a plurality of individual conductor paths serving to identify the activated switch site. For example, the conductive paths 15, 16 may comprise individual networks of conductive ink deposited on the facing surfaces of upper and lower insulative layers 13, 14.

As will now be apparent, keyboards fabricated in accordance with the invention are extremely simple, easy to assemble and durable in operation. In addition, by employing commercially available intermediate switch assemblies 12, the operation of each individual switch can be effected in a highly reliable fashion over a large number of switch cycles.

Figure 4:
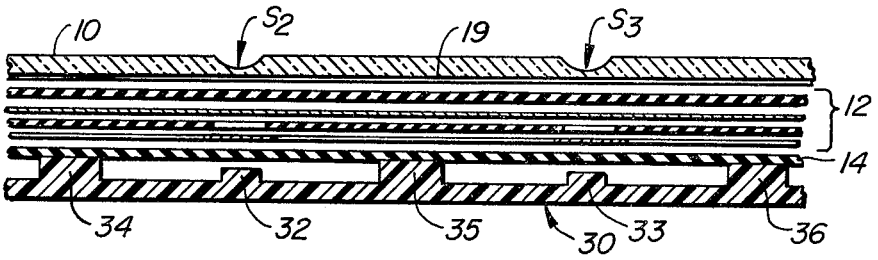
FIGS. 4–6 are partial sectional views illustrating alternate configurations for the top member of the invention.
Figure 5:
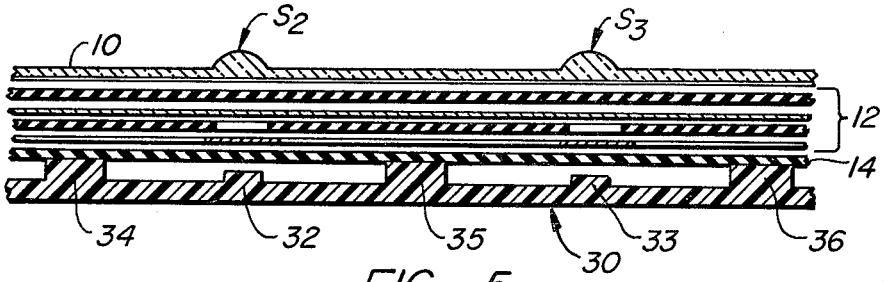
Figure 6:
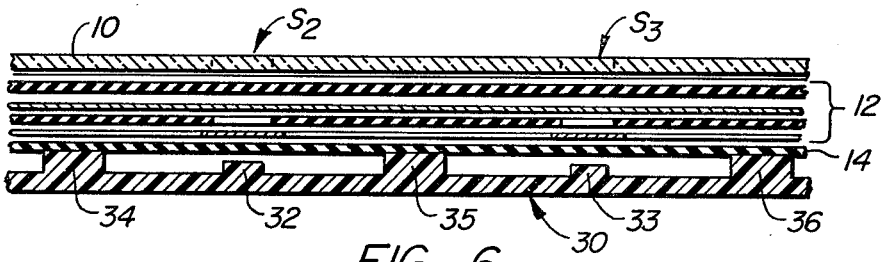

While the above provides a full and complete disclosure of the preferred embodiment of the invention, various modifications, alternate constructions and equivalents may be employed without departing from the true spirit and scope of the invention. For example, if desired indicia layer 19 may be eliminated and the key switch functions embossed, printed or otherwise placed on top member 10. In addition, although the concave depressions S1–SN are depected as having a convex bottom contour, the bottom surface of member 10 may be planar with concave depressions formed in the top surface as shown in FIG. 4, with typical thickness dimensions of 0.070 inch for the main planar portion and 0.030 inch for the minimum thickness dimension for each concave depression. Moreover, in some applications the switch site defining regions may be convex, rather than concave, or simply flat, as shown in FIGS. 5 and 6, respectively. Therefore, the above description should not be construed as limiting the scope of the invention which is defined by the appended claims.

What is claimed is:

1. A keyboard assembly comprising:

a flexible unitary top member having a plurality of switch site defining regions arranged in a predetermined array to define a keyboard;

a compressible intermediate switch assembly having a plurality of switch sites each underlying a different one of said projections; and a bottom member underlying said intermediate switch assembly and having a first and second plurality of projections extending toward said top member, each of said first plurality of projections underlying a different one of said switch sites, each of said second plurality of projections being located intermediate different adjacent ones of said switch sites, said second plurality of projections being longer than said first plurality of projections so as to contact the lower surface of said intermediate switch assembly, each of said first plurality of projections providing a compression contact beneath said intermediate switch assembly when the corresponding top member region is advanced toward said bottom member by a predetermined distance, said second plurality of projections providing mechanical isolation between the switch site underlying an advanced one of said top member regions and the remainder of said switch sites.

2. The invention of claim 1 further including an indicia bearing layer positioned between said top member and said intermediate switch assembly.

3. The invention of claim 1, wherein said switch site defining regions comprise concave depressions in the top surface of said top member.

4. The invention of claim 3, wherein said switch site defining regions further include convex protrusions on the bottom surface of said top member underlying said concave depressions.

5. The invention of claim 1, wherein said switch site defining regions comprise convex protrusions on the top surface of said top member.

6. The invention of claim 1, wherein said top member comprises a substantially flat sheet in the area of said predetermined array, and wherein said switch site defining regions comprise indicia positioned in said predetermined array.

* * * * *